US007935247B2

(12) United States Patent
Stark et al.

(10) Patent No.: US 7,935,247 B2
(45) Date of Patent: May 3, 2011

(54) METHOD FOR IMPROVING LIQUID YIELD DURING THERMAL CRACKING OF HYDROCARBONS

(75) Inventors: Joseph L. Stark, Richmond, TX (US); Thomas J. Falkler, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 9 days.

(21) Appl. No.: 12/211,469

(22) Filed: Sep. 16, 2008

(65) Prior Publication Data

US 2009/0014355 A1 Jan. 15, 2009

Related U.S. Application Data

(63) Continuation-in-part of application No. 11/072,346, filed on Mar. 4, 2005, now Pat. No. 7,425,259.

(60) Provisional application No. 60/551,539, filed on Mar. 9, 2004.

(51) Int. Cl.
*C10G 11/02* (2006.01)

(52) U.S. Cl. ..... 208/121; 208/122; 208/123; 208/124

(58) Field of Classification Search ..... 208/113–126, 208/131, 132

See application file for complete search history.

(56) References Cited

U.S. PATENT DOCUMENTS

| | | | | |
|---|---|---|---|---|
| 3,836,452 | A | | 9/1974 | Gleim |
| 3,948,759 | A | | 4/1976 | King et al. |
| 4,046,670 | A | | 9/1977 | Seguchi et al. |
| 4,163,728 | A | | 8/1979 | Cheng et al. |
| 4,312,745 | A | | 1/1982 | Hsu et al. |
| 4,399,024 | A | | 8/1983 | Fukui et al. |
| 4,404,092 | A | | 9/1983 | Audeh et al. |
| 4,455,219 | A | | 6/1984 | Janssen et al. |
| 4,518,487 | A | | 5/1985 | Graf et al. |
| 4,575,413 | A | | 3/1986 | Pizzoni et al. |
| 4,642,175 | A | | 2/1987 | Rudnick |
| 4,832,823 | A | | 5/1989 | Goyal et al. |
| 4,889,614 | A | * | 12/1989 | Forester ..... 208/48 AA |
| 4,927,519 | A | | 5/1990 | Forester |
| 5,358,626 | A | | 10/1994 | Gandman et al. |
| 5,407,560 | A | * | 4/1995 | Miyawaki et al. ..... 208/131 |
| 5,567,305 | A | * | 10/1996 | Jo ..... 208/48 R |
| 5,853,565 | A | | 12/1998 | Cayton |
| 5,858,208 | A | | 1/1999 | Flanders et al. |
| 6,169,054 | B1 | * | 1/2001 | Pereira et al. ..... 208/131 |
| 6,193,875 | B1 | | 2/2001 | Pereira et al. |
| 6,197,075 | B1 | | 3/2001 | Muir et al. |
| 6,228,253 | B1 | | 5/2001 | Gandman |
| 6,387,840 | B1 | | 5/2002 | Salazar et al. |
| 6,803,029 | B2 | | 10/2004 | Dieckmann |
| 2002/0122756 | A1 | | 9/2002 | Paulson et al. |

FOREIGN PATENT DOCUMENTS

| | | | |
|---|---|---|---|
| EP | 0266872 | A1 | 5/1988 |
| EP | 0267674 | A1 | 5/1988 |
| WO | WO9306195 | | 4/1993 |
| WO | WO2004104139 | A1 | 12/2004 |

* cited by examiner

*Primary Examiner* — Glenn Caldarola
*Assistant Examiner* — Randy Boyer
(74) *Attorney, Agent, or Firm* — Mossman Kumar & Tyler PC

(57) ABSTRACT

Metal additives to hydrocarbon feed streams give improved hydrocarbon liquid yield during thermal cracking thereof. Suitable additives include metal over-bases and metal dispersions and the metals suitable include, but are not necessarily limited to, magnesium, calcium, aluminum, zinc, silicon, barium, cerium, and strontium overbases and dispersions. Particularly useful metals include magnesium alone or magnesium together with calcium, barium, strontium, boron, zinc, silicon, cerium, titanium, zirconium, chromium, molybdenum, tungsten, and/or platinum. In one non-limiting embodiment, no added hydrogen is employed. Coker feedstocks are a particular hydrocarbon feed stream to which the method can be advantageously applied, but the technique may be used on any hydrocarbon feed that is thermally cracked.

16 Claims, 3 Drawing Sheets

METHOD FOR IMPROVING LIQUID YIELD DURING THERMAL CRACKING OF HYDROCARBONS

CROSS-REFERENCE TO RELATED APPLICATIONS

This application is a continuation-in-part of U.S. patent application Ser. No. 11/072,346 filed Mar. 4, 2005, issued Sep. 16, 2008 as U.S. Pat. No. 7,425,259, which claims the benefit of U.S. Provisional Application No. 60/551,539 filed Mar. 9, 2004.

TECHNICAL FIELD

The present invention relates to methods and compositions for improving liquid yields during thermal cracking of hydrocarbons, and more particularly relates, in one embodiment, to methods and compositions for improving liquid yields during thermal cracking of hydrocarbons by introducing an additive into the hydrocarbon.

BACKGROUND

Many petroleum refineries utilize a delayed coking unit to process residual oils. Delayed coking is a process for obtaining valuable products from the otherwise poor source of heavy petroleum bottoms. Delayed coking raises the temperature of these bottoms in a process or coking furnace and converts the bulk of them to coke in a coking drum. The liquid in the coking drum has a long residence time to convert the resid oil to lower molecular weight hydrocarbons which distill out of the coke drum. Overhead vapors from the coking drum pass to a fractionator where various fractions are separated. One of the fractions is a gasoline boiling range stream. This stream, commonly referred to as coker gasoline, is generally a relatively low octane stream, suitable for use as an automotive fuel with upgrading. The liquid products from this thermal cracking are generally more valuable than the coke produced. Delayed coking is one example of a process for recovering valuable products from processed oil using thermal cracking of heavy bottoms to produce valuable gas and liquid fractions and less valuable coke.

It would thus be desirable to provide a method and/or composition that would improve the yield of liquid hydrocarbon products from a thermal cracking process.

SUMMARY

In carrying out these and other objects of the invention, there is provided, in one form, a method for improving liquid yield during thermal cracking of a refinery hydrocarbon in the absence of added hydrogen. The method involves introducing a metal additive and a dispersant to a refinery hydrocarbon feed stream. The metal additive may be a metal overbase or a metal dispersion. The metal in the metal additive may be magnesium alone or magnesium together with a second component. The second component may be calcium, barium, strontium, boron, zinc, silicon, cerium, titanium, zirconium, chromium, molybdenum, tungsten and/or platinum. Further, the metal in the metal additive may be two metals, where the two metals are barium, strontium, boron, silicon, cerium, titanium, zirconium, and/or platinum. The metal further involves heating the refinery hydrocarbon feed stream to a thermal cracking temperature, and then recovering a hydrocarbon liquid product.

In another non-limiting embodiment of the invention, there is provided a refinery process that concerns a coking operation which involves introducing a metal additive and a dispersant to a coker feed stream. The metal additive may be magnesium alone or magnesium together with a second component. The second component may be calcium, barium, strontium, boron, zinc, silicon, cerium, titanium, zirconium, chromium, molybdenum, tungsten and/or platinum. The metal in the metal additive may also be two metals, such as barium, strontium, boron, silicon, cerium, titanium, zirconium, and/or platinum. The refinery process further involves heating the coker feed stream to a thermal cracking temperature, and recovering a hydrocarbon liquid product.

DETAILED DESCRIPTION

Figure 1:
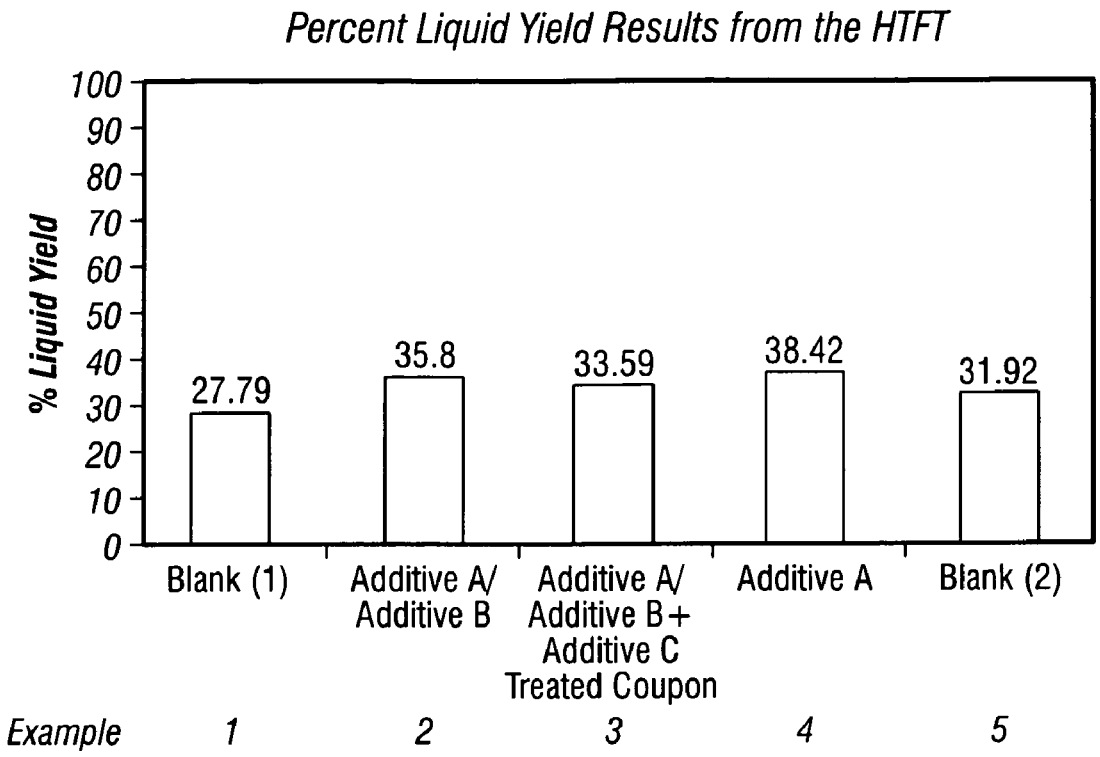
FIG. 1 is a chart of percent liquid yield results for Examples 1-5 using thermal cracking on a HTFT hydrocarbon stream.

It has been discovered that the use of overbase additives or metal dispersions improves liquid yield during the thermal cracking of a hydrocarbon, such as a thermal coking process. Any approach to increase the liquid yield during coke production will have a significant value to the operator.

It is expected that the method and additives of this invention would be useful for any hydrocarbon feed stream that is to be thermally cracked, such as in a coking application, including, but not necessarily limited to, coker feed streams, atmospheric tower bottoms, vacuum tower bottoms, slurry from an FCC unit, visbreaker streams, slops, and the like. As noted previously, thermal cracking processes to which the invention may be applied include, but are not necessarily limited to, delayed coking, flexicoking and fluid coking and the like.

Suitable metal additives for use in this invention include, but are not necessarily limited to, magnesium overbases, calcium overbases, aluminum overbases, zinc overbases, silicon overbases, barium overbases, strontium overbases, cerium overbases and mixtures thereof, as well as dispersions. In one non-limiting embodiment, the metal is magnesium alone or magnesium together with a second component that may be barium, strontium, aluminum, boron, silicon, cerium, titanium, zirconium, and/or platinum. In an alternative embodiment, the metal additive may include two, and only two, metals from the group of barium, strontium, aluminum, boron, silicon, cerium, titanium, zirconium, and/or platinum. These overbases and dispersions are soluble in hydrocarbons, even though it is generally harder to get these additives dispersed in hydrocarbon as contrasted with aqueous systems. In one non-limiting embodiment of the invention, the metal additive contains at least about 1 wt % magnesium, calcium, aluminum, zinc, silicon, barium, cerium or strontium. In one alternative embodiment, the additive contains about 5 wt % metal, in another non-limiting embodiment, the amount of metal or alkali earth metal is at least about 17 wt %, and in a different alternate embodiment, at least about 40 wt %. Processes for making these metal overbases and dispersion materials are known. In one non-limiting embodiment, the metal overbase is made by heating a tall oil with magnesium hydroxide. In another embodiment the overbases are made using aluminum oxide. The overbases are colloidal suspensions. In another embodiment dispersions are made using magnesium oxide or aluminum oxide. Other suitable starting compounds besides the metal hydroxides and metal oxides include, but are not necessarily limited to, metal carboxylates and hydrocarbon-soluble metal alkyl compounds. Additionally, any metal compound that degrades, decomposes or otherwise converts to a metal oxide or metal hydroxide may be employed. Dispersions and overbases made using other metals would be prepared similarly. In one non-limiting embodiment the target particle size of these dispersions and overbases is about 10 microns or less, alternatively about 1 micron or less. It will be appreciated that all of the particles in the additive are not of the target size, but that a "bell-shaped" distribution is obtained so that the average particle size distribution is 10μ or less, or alternatively 1μ or less.

In further detail, the metal dispersions or complexes useful in the present invention may be prepared in any manner known to the prior art for preparing overbased salts, provided that the overbase complex resulting therefrom is in the form of finely divided, and in one non-limiting embodiment, submicron particles which form a stable dispersion in the hydrocarbon feed stream. Thus, one non-restrictive method for preparing the additives of the present invention is to form a mixture of a base of the desired metal, e.g., $Mg(OH)_2$, with a complexing agent, e.g. a fatty acid such as a tall oil fatty acid, which is present in a quantity much less than that required to stoichiometrically react with the hydroxide, and a non-volatile diluent. The mixture is heated to a temperature of about 250-350° C., whereby there is afforded the overbase complex or dispersion of the metal oxide and the metal salt of the fatty acid.

The above described method of preparing the overbase complexes of the present invention is particularly set forth in U.S. Pat. No. 4,163,728 which is incorporated herein by reference in its entirety, wherein for example, a mixture of $Mg(OH)_2$ and a carboxylic acid complexing agent is heated at a temperature of about 280-330° C. in a suitable non-volatile diluent.

Complexing agents which are used in the present invention include, but are not necessarily limited to, carboxylic acids, phenols, organic phosphorus acids and organic sulfur acids. Included are those acids which are presently used in preparing overbased materials (e.g. those described in U.S. Pat. Nos. 3,312,618; 2,695,910; and 2,616,904, and incorporated by reference herein) and constitute an art-recognized class of acids. The carboxylic acids, phenols, organic phosphorus acids and organic sulfur acids which are oil-soluble per se, particularly the oil-soluble sulfonic acids, are especially useful. Oil-soluble derivatives of these organic acidic substances, such as their metal salts, ammonium salts, and esters (particularly esters with lower aliphatic alcohols having up to six carbon atoms, such as the lower alkanols), can be utilized in lieu of or in combination with the free acids. When reference is made to the acid, its equivalent derivatives are implicitly included unless it is clear that only the acid is intended. Suitable carboxylic acid complexing agents which may be used herein include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids and alkyl- or alkenyl-substituted aromatic carboxylic acids. The aliphatic acids generally are long chain acids and contain at least eight carbon atoms and in one non-limiting embodiment at least twelve carbon atoms. The cycloaliphatic and aliphatic carboxylic acids can be saturated or unsaturated.

The metal additives acceptable for the method of this invention also include true overbase compounds where a carbonation procedure has been done. Typically, the carbonation involves the addition of $CO_2$, as is well known in the art.

It is difficult to predict in advance what the proportion of the overbase additive of this invention should be in the hydrocarbon feed stream that it is applied to. This proportion depends on a number of complex, interrelated factors including, but not necessarily limited to, the nature of the hydrocarbon fluid, the temperature and pressure conditions of the coker drum or other process unit, the amount of asphaltenes in the hydrocarbon fluid, the particular inventive composition used, etc. It has been discovered that higher levels of asphaltenes in the feed require higher levels of additive, that is, the level of additive should correspond to and be directly proportional to the level of asphaltenes in the feed. Nevertheless, in order to give some sense of suitable proportions, the proportion of the overbase additive of the invention may be applied at a level between about 1 ppm to about 1000 ppm, based on the hydrocarbon fluid. In another non-limiting embodiment of the invention, the upper end of the range may be about 500 ppm, and alternatively up to about 300 ppm. In a different non-limiting embodiment of the invention, the lower end of the proportion range for the overbase additive may be about 50 ppm, and alternatively, another non-limiting range may be about 75 ppm.

While the overbase additive can be fed to the coker feedstock, or into the side of the delayed coker, in one non-limiting embodiment of the invention, the additive is introduced as far upstream of the coker furnace as possible without interfering with other units. In part, this is to insure complete mixing of the additive with the feed stream, and to allow for maximum time to stabilize the oil and asphaltenes in the stream.

The thermal cracking of the hydrocarbon feed stream should be conducted at relatively high temperatures, in one non-limiting embodiment at a temperature between about 850° F. (454° C.) up to about 1500° F. (816° C.), alternatively up to about 1300° F. (704° C.). In another non-limiting embodiment, the inventive method is practiced at a thermal cracking temperature between about 900° F. (482° C.) and about 950° F. (510° C.). The method herein may also be applied to visbreaker feeds, which are heated to somewhat lower or reduced temperatures for instance in the range of about 662° F. (350° C.) to about 800° F. (427° C.). Soaker type visbreakers tend to hold the hydrocarbon at a lower temperature for a relatively longer period of time, whereas coil type visbreakers process faster at higher temperatures, e.g. about 900° F. (482° C.).

A dispersant may be optionally used together with the overbase additive to help the additive disperse through the hydrocarbon feedstock. The proportion of dispersant may range from about 1 to about 500 ppm, based on the hydrocarbon feedstock. Alternatively, in another non-limiting embodiment, the proportion of dispersant may range from about 20 to about 100 ppm. Suitable dispersants include, but are not necessarily limited to, copolymers of carboxylic anhydride and alpha-olefins, particularly alpha-olefins having from 2 to 70 carbon atoms. Suitable carboxylic anhydrides include aliphatic, cyclic and aromatic anhydrides, and may include, but are not necessarily limited to maleic anhydride, succinic anhydride, glutaric anhydride, tetrapropylene succininc anhydride, phthalic anhydride, trimellitic anhydride (oil soluble, non-basic), and mixtures thereof. Typical copolymers include reaction products between these anhydrides and alpha-olefins to produce oil-soluble products. Suitable alpha olefins include, but are not necessarily limited to ethylene, propylene, butylenes (such as n-butylene and isobutylene), C2-C70 alpha olefins, polyisobutylene, and mixtures thereof A typical copolymer is a reaction product between maleic anhydride and an alpha-olefin to produce an oil soluble dispersant. A useful copolymer reaction product is formed by a 1:1 stoichiometric addition of maleic anhydride and polyisobutylene. The resulting product has a molecular weight range from about 5,000 to 10,000, in another non-limiting embodiment.

In another non-limiting embodiment, the method herein may be advantageously practiced in the absence of added hydrogen. By "in the absence of added hydrogen" is meant the method herein for improving liquid yield involving introducing a metal additive to a hydrocarbon feed stream, in one embodiment a coker feed stream. The limitation does not necessarily apply to the remainder of or other parts or unit operations of a refinery process. The method in another non-restrictive version may be practiced in the absence of a glass-forming oxide, such as an oxide of silicon, boron, phosphorus, molybdenum, tungsten, vanadium and mixtures thereof.

The invention will now be described with respect to certain more specific Examples which are only intended to further describe the invention, but not limit it in any way.

TABLE I

MATERIALS USED IN EXPERIMENTS

| MATERIAL DESIGNATION | DESCRIPTION |
|---|---|
| Additive A | Magnesium dispersion containing approximately 17 wt % Mg |
| Additive B | Carboxylic anhydride/$C_{20-24}$ alpha olefin copolymer dispersant |
| Additive C | Metal passivator |
| Additive D | Aluminum overbase made using sulfonic acid |

Experimental High Temperature Fouling Test (HTFT) Procedure

Samples of heated coker feed were poured out in preweighed 100 mL beakers. The amount of the sample was weighed and recorded. Prior to a HTFT run, the preweighed beaker with coker feed was heated to about 400° F. (204° C.). The base of a Parr pressure vessel was preheated to about 250° F. (121° C.). For samples where Additive C was used, a metal coupon was pretreated with the Additive C. The coupon was then placed in a warmed oil sample. If Additive B or Additive A were to be added, it was done so as the feed was heated and had become liquid.

The HTFT sample was heated to the desired temperature, normally 890° F. (477° C.) to 950° F. (510° C.), dependent on the furnace outlet temperature in which the coker feed was processed. When the coker sample, autoclave base, and HTFT furnace had all reached the appropriate test temperature, the sample beaker was placed into the autoclave base and the autoclave top was secured to the base. The closed vessel was then placed into the heated furnace. An automated computer-based test program then recorded the test elapsed time, sample temperature and autoclave pressure every 30 seconds throughout the test run. When the coker feed had reached the desired test temperature, liquid hydrocarbon and vapors were vented from the vessel at predetermined pressure levels until all available liquid/gas hydrocarbons were removed from the coker feed as coking occurs. This process was usually completed in seven to ten minutes after the coker feed test sample reached the set test temperature, i.e. 920° F. (493° C.). Upon cooling, the condensed liquid/gas hydrocarbon was measured to the nearest 0.5 mL and the weight of the liquid was recorded. The density of the liquid was recorded and the yield percentage was calculated.

Results

Results for measuring the percent liquid yield are shown in FIG. 1. The data show that when magnesium overbase Additive A was included in the feed, the level of liquid yield (Examples 2-4) was consistently greater than that of the untreated samples (Examples 1 and 5). In determining the liquid yield increase, the amount of liquid added to the samples when adding additive was subtracted out, thereby making the calculated results conservative. It would be expected that any carrier solvent added would go with the gas fraction.

Figure 2:
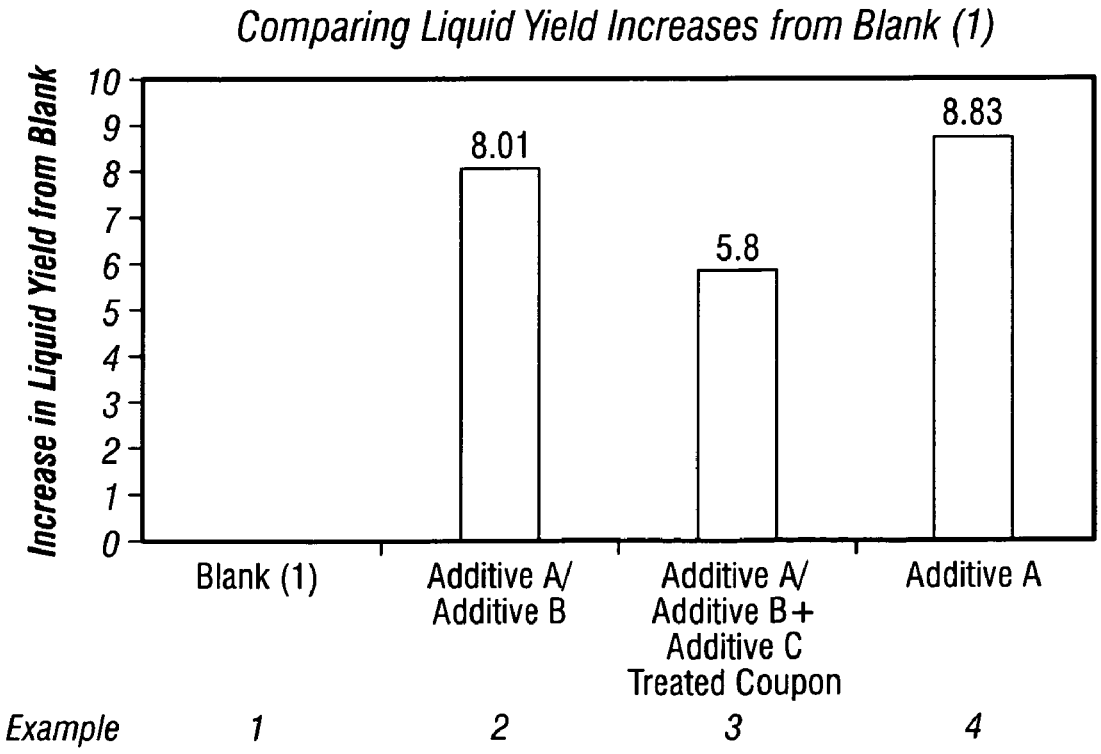
FIG. 2 is a chart comparing liquid yield increases of Examples 2-4 with blank (1) (Example 1) of FIG. 1.
Figure 3:
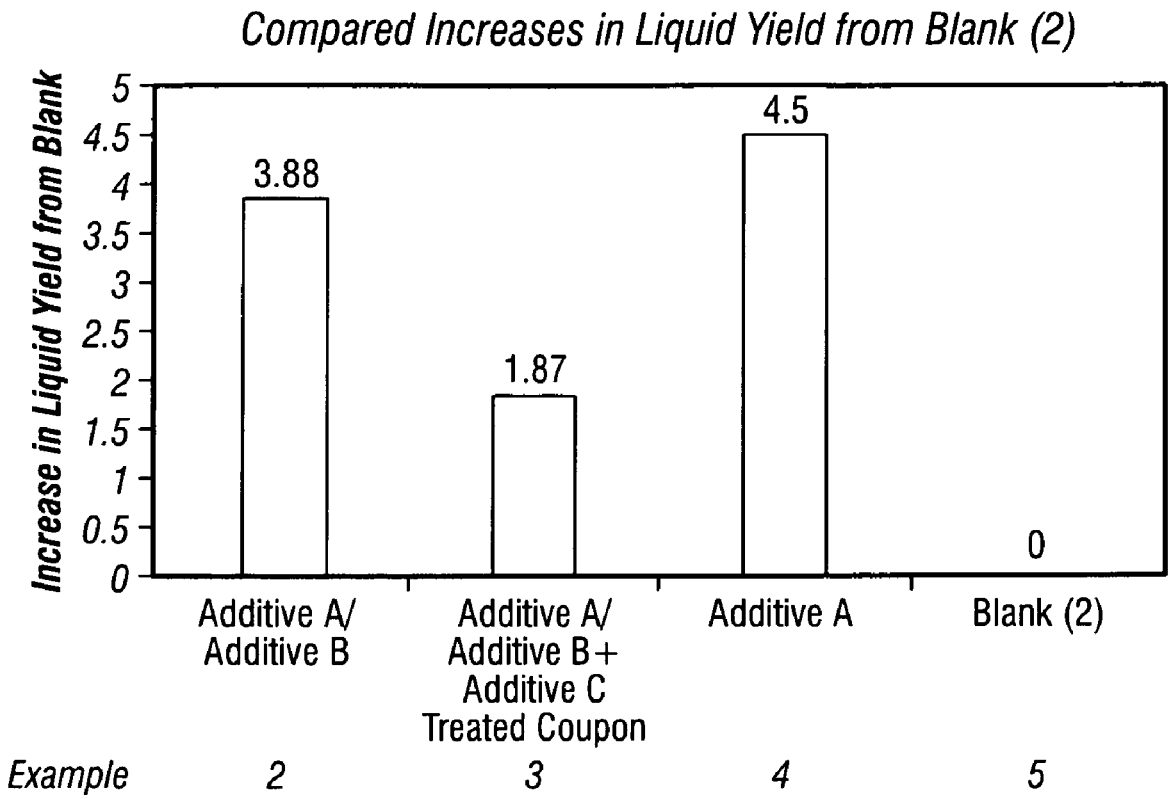
FIG. 3 is a chart comparing liquid yield increases of Examples 2-4 with blank (2) (Example 5) of FIG. 1.

The increase in liquid yield in comparing samples with Additive A to those without Additive A ranges between 1.67 to 8.63. Liquid yield increases compared to blank (1) (Example 1) and blank (2) (Example 5) are shown in FIGS. 2 and 3, respectively.

Figure 4:
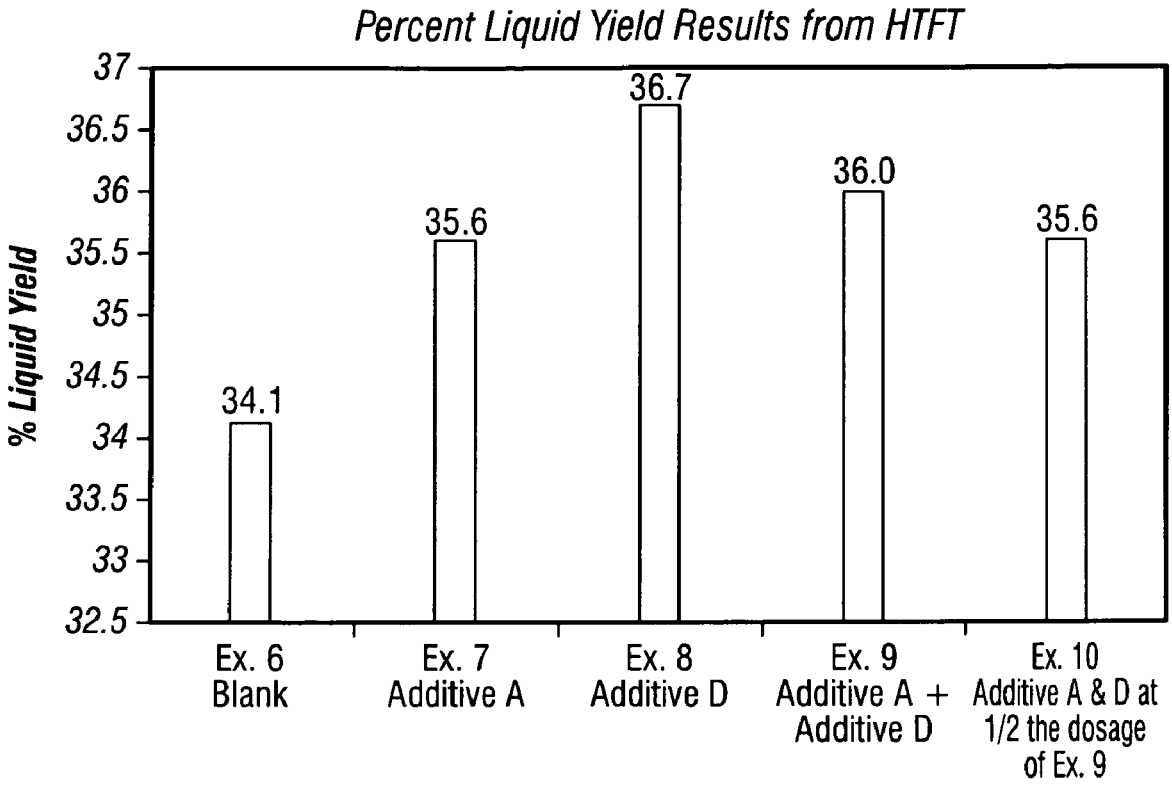
FIG. 4 is a chart of percent liquid yield results for Examples 6-10 using thermal cracking on a HTFT hydrocarbon stream.

Additional results are presented in FIG. 4 using the same heated coker feed as for Examples 1-5. Example 7 using Mg dispersion Additive A gave a yield % increase of 1.5% over a 34.1% yield of the blank of Example 6 to 35.6%. Example 8 using the Al overbase Additive D gave a yield % of 36.7%, which was 2.6% higher than the blank. Example 9 employing a 50/50 combination of Additive A and Additive D gave a liquid yield % of 36.0%, improved by 1.9% over the blank of Example 6. Finally, Example 10 used a 50/50 combination of Additive A and Additive D as in Example 9, but at one-half the treatment rate of Example 9. Example 10 gave a 35.6% liquid yield, which was 1.5% over the liquid yield % of the blank Example 6. These Examples thus demonstrate that the use of a combination of metal additives may improve liquid yield.

The method for improving the liquid yield from a thermal cracking process may be applied to thermal cracking processes including, but not necessarily limited to, delayed coking, flexicoking, fluid coking and the like. The method further involves improving liquid yield during delayed coking, flexicoking, fluid coking, or visbreaking using a readily available additive.

The economic value of the invention that a refinery would observe is subject to the level of liquid yield increase and the value of the quality of liquid obtained. It is expected that a conservative increase in using the overbase additives of the invention would improve the liquid yield by about 2.5%, which would be a significant contribution over the course of a year.

In the foregoing specification, the invention has been described with reference to specific embodiments thereof, and has been demonstrated as effective in improving liquid yields from thermal cracking of coker feedstock, as a non-limiting example. However, it will be evident that various modifications and changes can be made thereto without departing from the broader spirit or scope of the invention as set forth in the appended claims. Accordingly, the specification is to be regarded in an illustrative rather than in a restrictive sense. For example, specific crosslinked overbase additives, and combinations thereof with other dispersants, and different hydrocarbon-containing liquids other than those specifically exemplified or mentioned, or in different proportions, falling within the claimed parameters, but not specifically identified or tried in a particular application to improve liquid yield, are within the scope of this invention. Similarly, it is expected that the inventive compositions will find utility as yield-improving additives for other hydrocarbon-containing fluids besides those used in delayed coker units.

The present invention may suitably comprise, consist or consist essentially of the elements disclosed and may be practiced in the absence of an element not disclosed.

The words "comprising" and "comprises" as used throughout the claims is to interpreted "including but not limited to".

We claim:

1. A method for improving liquid yield during thermal cracking of a refinery hydrocarbon comprising, in the absence of added hydrogen:

introducing a metal additive and a dispersant to a refinery hydrocarbon feed stream, where the metal additive is selected from the group consisting of a metal overbase and a metal dispersion, where the metal in the metal additive is selected from the group consisting of:

magnesium alone or magnesium together with a second component selected from the group consisting of calcium, barium, strontium, boron, zinc, silicon, titanium, zirconium, chromium, molybdenum, tungsten and platinum; and two metals selected from the group consisting of calcium, barium, strontium, zinc, and silicon;

heating the refinery hydrocarbon feed stream to a thermal cracking temperature; and recovering a hydrocarbon liquid product.

2. The method of claim 1 where the metal in the metal additive is selected from the group consisting of: magnesium alone or magnesium together with a second component selected from the group consisting of calcium, barium, strontium, boron, zinc, silicon, titanium, zirconium, chromium, molybdenum, tungsten and platinum.

3. The method of claim 1 where the metal additive contains at least about 1 wt % metal.

4. The method of claim 1 where the thermal cracking temperature is between about 662° F. (350° C.) and about 1500° F. (816° C.).

5. The method of claim 1 where the amount of hydrocarbon liquid product is increased as compared with an identical method absent the overbase additive.

6. The method of claim 1 where the refinery hydrocarbon feed stream is a coker feed stream.

7. The method of claim 1 where the average particle size of the additive ranges from about 50 microns to about 0.001 microns.

8. The method of claim 1 where the hydrocarbon comprises sulfur and the hydrocarbon liquid product has reduced sulfur content as compared to a hydrocarbon liquid product produced by an identical process absent the additive.

9. A method for improving liquid yield during thermal cracking of a refinery hydrocarbon comprising:

introducing a metal additive and a dispersant to a refinery hydrocarbon feed stream, where the metal additive is selected from the group consisting of a metal overbase and a metal dispersion, where the metal in the metal additive is selected from the group consisting of:

magnesium alone or magnesium together with a second component selected from the group consisting of barium, strontium, boron, silicon, titanium, zirconium, and platinum, and two metals selected from the group consisting of calcium, barium, strontium, zinc, and silicon;

where the metal additive contains at least about 1 wt % metal;

heating the refinery hydrocarbon feed stream to a thermal cracking temperature; and recovering a hydrocarbon liquid product;

where the amount of hydrocarbon liquid product is increased as compared with an identical method absent the overbase additive.

10. The method of claim 9 where the metal in the metal additive is selected from the group consisting of: magnesium alone or magnesium together with a second component selected from the group consisting of calcium, barium, strontium, boron, zinc, silicon, titanium, zirconium, chromium, molybdenum, tungsten and platinum.

11. The method of claim 9 where the thermal cracking temperature is between about 662° F. (350° C.) and about 1500° F. (816° C.).

12. A refinery process comprising a coking operation further comprising:

introducing a metal additive and a dispersant to a coker feed stream, where the metal additive is selected from the group consisting of:

magnesium alone or magnesium together with a second component selected from the group consisting of calcium, barium, strontium, boron, zinc, silicon, titanium, zirconium, chromium, molybdenum, tungsten and platinum; and two metals selected from the group consisting of calcium, barium, strontium, zinc, and silicon;

heating the coker feed stream to a thermal cracking temperature; and recovering a hydrocarbon liquid product.

13. The refinery process of claim 12 where the metal in the metal additive is selected from the group consisting of: magnesium alone or magnesium together with a second component selected from the group consisting of barium, strontium, boron, silicon, titanium, zirconium, and platinum.

14. The refinery process of claim 12 where the overbase additive contains at least about 1 wt % metal.

15. The refinery process of claim 12 where the thermal cracking temperature is between 662° F. (350° C.) and about 1500° F. (816° C.).

16. The refinery process of claim 12 where the amount of hydrocarbon liquid product is increased as compared with an identical method absent the overbase additive.

* * * * *